US010677473B2

(12) United States Patent
Stephens et al.

(10) Patent No.: US 10,677,473 B2
(45) Date of Patent: Jun. 9, 2020

(54) OVEN WITH CLEANING SYSTEM AND GREASE AND WATER FLOW SEPARATION

(71) Applicant: ILLINOIS TOOL WORKS INC., Glenview, IL (US)

(72) Inventors: Jason M. Stephens, Bonney Lake, WA (US); Troy R. Tope, Puyallup, WA (US); Daniel L. Kerby, Spanaway, WA (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 556 days.

(21) Appl. No.: 15/305,191

(22) PCT Filed: Apr. 20, 2015

(86) PCT No.: PCT/US2015/026618
§ 371 (c)(1),
(2) Date: Oct. 19, 2016

(87) PCT Pub. No.: WO2015/164236
PCT Pub. Date: Oct. 29, 2015

(65) Prior Publication Data

US 2017/0045233 A1 Feb. 16, 2017

Related U.S. Application Data

(60) Provisional application No. 61/982,698, filed on Apr. 22, 2014, provisional application No. 62/028,612, (Continued)

(51) Int. Cl.
*F24C 14/00* (2006.01)
*F24C 15/14* (2006.01)

(52) U.S. Cl.
CPC ..... *F24C 14/005* (2013.01); *F24C 15/14* (2013.01)

(58) Field of Classification Search
CPC ..... F24C 14/005; F24C 15/14; A21B 3/006; A21B 3/04
(Continued)

(56) References Cited

U.S. PATENT DOCUMENTS 2,856,166 A * 10/1958 Goettl ..... F24F 6/04 261/29
3,245,668 A * 4/1966 Goettl ..... F24F 6/04 261/94
(Continued)

FOREIGN PATENT DOCUMENTS

CH 691280 6/2001
CN 1593303 3/2005
(Continued)

OTHER PUBLICATIONS

International Preliminary Search Report on Patentability, PCT, International Search Report and Written Opinion, International Application No. PCT/US2015/026618; dated Nov. 3, 2016, 15 pages.
(Continued)

*Primary Examiner* — David G Cormier
*Assistant Examiner* — Thomas Bucci
(74) *Attorney, Agent, or Firm* — Thompson Hine LLP

(57) ABSTRACT

Ovens having spray systems for spraying cleaning fluid in a cooking chamber are disclosed that include a chamber drain flow path that leads to a grease drain path and a water drain path. A baffle wall in the chamber drain flow path controls the flow of fluid between the grease drain path and the water drain path. The chamber drain flow path may also have a recirculation path to return water to the spray system. Ovens having spray systems for cleaning are disclosed that include a door having a latch mechanism that automatically latches upon closure of the door and a gasket disposed between the
(Continued)

door and an oven housing that directs water impinging upon the door back into the cooking chamber and the chamber drain flow path. The door may have an inner glass pane and an outer glass pane pivotably mounted to the inner glass pane.

8 Claims, 17 Drawing Sheets

Related U.S. Application Data filed on Jul. 24, 2014, provisional application No. 62/028,619, filed on Jul. 24, 2014, provisional application No. 62/028,831, filed on Jul. 25, 2014, provisional application No. 62/028,832, filed on Jul. 25, 2014.

(58) Field of Classification Search
USPC ..... 134/169 R, 22.1, 115 R, 22.18, 18, 108, 134/56 R; 126/20, 21 A, 369, 19 R, 198; 219/401
See application file for complete search history.

(56) References Cited

U.S. PATENT DOCUMENTS

| | | | | |
|---|---|---|---|---|
| 3,831,580 | A * | 8/1974 | McLean | E05C 5/00 126/197 |
| 4,113,617 | A * | 9/1978 | Bereskin | E03F 5/16 210/742 |
| 4,200,599 | A * | 4/1980 | Goettl | F24F 6/04 261/97 |
| 4,234,526 | A * | 11/1980 | MacKay | F24F 6/04 261/106 |
| 4,646,630 | A | 3/1987 | McCoy et al. | |
| 4,657,709 | A * | 4/1987 | Goettl | F24F 6/04 239/193 |
| 4,924,072 | A | 5/1990 | Oslin | |
| 5,394,791 | A | 3/1995 | Vallee | |
| 5,447,145 | A * | 9/1995 | Cappello | F24C 15/04 126/194 |
| 5,549,038 | A | 8/1996 | Kolvites | |
| 5,552,578 | A | 9/1996 | Violi | |
| 5,601,013 | A | 2/1997 | Larsson et al. | |
| 5,653,164 | A | 8/1997 | Vallee | |
| 5,694,835 | A | 12/1997 | Mangina | |
| 5,869,812 | A | 2/1999 | Creamer et al. | |
| 6,213,002 | B1 * | 4/2001 | Batten | B01D 17/0208 99/340 |
| 6,435,078 | B1 * | 8/2002 | Batten | B01D 17/0208 99/446 |
| 6,516,712 | B1 | 2/2003 | Ratermann et al. | |
| 6,582,205 | B2 * | 6/2003 | Batten | F04B 9/107 210/513 |
| 6,966,582 | B1 * | 11/2005 | Malone | F24C 15/022 292/109 |
| 8,193,470 | B1 * | 6/2012 | Harlamert | F24C 14/005 126/20 |
| 2002/0170864 | A1 * | 11/2002 | Batten | B01D 17/00 210/803 |
| 2003/0145847 | A1 * | 8/2003 | Deuringer | F24C 14/005 126/377.1 |
| 2005/0076900 | A1 * | 4/2005 | Walther | F24C 15/006 126/198 |
| 2005/0235980 | A1 * | 10/2005 | Hansen | A21B 3/00 126/19 R |
| 2006/0001273 | A1 * | 1/2006 | Smith | F24C 15/022 292/204 |
| 2007/0262590 | A1 * | 11/2007 | Courter, IV | E05B 17/0029 292/201 |
| 2008/0149553 | A1 * | 6/2008 | Sowerby | B01D 17/005 210/301 |
| 2008/0223357 | A1 * | 9/2008 | Bartelick | B08B 9/00 126/21 A |
| 2008/0276925 | A1 * | 11/2008 | Griswold | F24C 15/022 126/19 R |
| 2009/0178576 | A1 * | 7/2009 | Valentine | A47J 37/042 99/421 H |
| 2012/0085244 | A1 | 4/2012 | Giazzon et al. | |
| 2012/0111849 | A1 | 5/2012 | Henry et al. | |
| 2013/0133638 | A1 * | 5/2013 | Kulakowski | F24C 15/327 126/19 R |
| 2013/0234578 | A1 * | 9/2013 | Ala | E05B 15/0086 312/326 |
| 2013/0318880 | A1 * | 12/2013 | Edwards | F24C 15/04 49/399 |
| 2013/0319393 | A1 * | 12/2013 | Harward | F24C 15/04 126/190 |
| 2014/0290500 | A1 * | 10/2014 | Wurdinger | F24C 15/2007 99/403 |
| 2014/0311360 | A1 * | 10/2014 | Bartelick | F24C 3/124 99/468 |
| 2014/0319119 | A1 | 10/2014 | Raghavan et al. | |

FOREIGN PATENT DOCUMENTS

| | | |
|---|---|---|
| CN | 1729374 | 2/2006 |
| DE | 19843842 | 3/2000 |
| DE | 10157808 A1 | 6/2003 |
| DE | 202004000106 | 6/2004 |
| DE | 202009006424 | 8/2009 |
| DE | 102008025294 | 12/2009 |
| DE | 102012221857 | 5/2013 |
| EP | 0712578 | 5/1996 |
| EP | 1102010 | 5/2001 |
| EP | 1148764 | 10/2001 |
| EP | 1384406 | 1/2004 |
| EP | 1517092 | 3/2005 |
| EP | 1914479 | 4/2008 |
| EP | 2703729 | 3/2014 |
| GB | 2163845 | 3/1986 |
| KR | 20130027863 | 3/2013 |
| WO | WO 9117661 | 11/1991 |
| WO | WO 2004094912 | 11/2004 |
| WO | WO 2002/068876 | 9/2005 |
| WO | WO 2011/128103 | 10/2011 |

OTHER PUBLICATIONS

PCT, International Search Report and Written Opinion, International Application No. PCT /US2015/026618; dated Oct. 23, 2015, 20 pages.

* cited by examiner

OVEN WITH CLEANING SYSTEM AND GREASE AND WATER FLOW SEPARATION

TECHNICAL FIELD

This application relates generally to ovens and, more specifically, to ovens with steaming and/or cleaning systems and an arrangement to prevent grease flow along a cleaning water recirculation path.

BACKGROUND

Ovens including steaming and/or cleaning systems can create issues for handling of grease. Ovens including steaming and/or spray cleaning systems can also create issues for maintaining steam and/or liquid within the cooking chamber.

It would be desirable to provide an oven with a cleaning system and an arrangement that limits water travel into a grease receptacle and/or that limits grease travel to municipal drain systems. It would be desirable to provide an oven with a positive latch arrangement that is ergonomically convenient to use. It would also be desirable to provide an oven with a door gasket arrangement that is effective.

Ovens including doors with both an inner and an outer glass panes are known. In these existing ovens, the outer glass pane is rigidly mounted to the frame so that the inner glass pane can be swung away from the outer glass pane. It would be desirable to provide an oven with a door arrangement that effectively applies pressure to a gasket and/or better facilitates cleaning between the glass panes.

SUMMARY

According to one aspect disclosed herein, an oven includes a cooking chamber, a spray system for spraying cleaning fluid in the cooking chamber, and a chamber drain flow path that leads to each of a grease drain path and a water drain path, wherein the water drain path includes one of an associated drain pump or drain valve and the grease drain path lacks a drain pump. The grease drain path may be controlled by a valve. In another aspect of the previous embodiment, a first flow opening from the chamber drain flow path to the water drain path is elevated relative to a second flow opening from the chamber drain flow path to the grease drain path.

In another aspect of the previous embodiments, a baffle wall extends upward from a bottom of the chamber drain flow path to the first flow opening, and liquid must travel over the baffle wall to reach the drain pump or drain valve. In another aspect of the previous embodiments, the chamber drain flow path further leads to a recirculation path of the spray system, the recirculation path including a wash pump. A third flow opening from the chamber drain flow path to the recirculation path is elevated relative to the second flow opening.

In another aspect of the previous embodiments, the oven includes a controller configured to maintain the valve in an open condition during cooking operations such that grease flows downward through the second flow opening and along the grease flow path under the force of gravity without reaching the first flow opening. In another aspect, the controller is configured to close the valve during an oven cleaning operation.

In another aspect of the previous embodiments, an oven includes a cooking chamber and a door movable between open and closed positions for accessing the cooking chamber. The door includes latch member that automatically latches upon closure of the door. In another aspect, the door includes a handle for opening the door, and user interaction with the handle is not required to close the door and effect latching of the latch member. In another aspect of the previous embodiments, the latch member is biased into a latching position and includes a ramped surface that interacts with a latch pin upon door closure to temporarily move the latch member out of its latching position. In another aspect of the previous embodiments, a linking arrangement connects the handle with the latch member such that when the door is in the closed position, pulling the handle away from the door causes the linking arrangement to move the latch member to an unlatched position. In another aspect, the handle includes a grip portion and at least two arms that are spaced apart (spaced apart arms) and extend to the door, and wherein the grip portion maintains a consistent orientation relative to the door when the handle is pulled away from the door.

In another aspect of the previous embodiments, an oven includes a cooking chamber with an access opening, a spray system for spraying cleaning fluid in the cooking chamber, a door movable between an open position(s) and a closed position relative to the access opening, and a gasket positioned between the door and an oven housing when the door is in the closed position to redirect sprayed water that impinges upon the door back into the cooking chamber. In another aspect of the previous embodiment, the gasket includes a mount portion positioned alongside the access opening and having an outwardly-facing domed portion that seals against an inner surface of the door at a first location. In another aspect of the previous embodiment, the gasket includes an inner portion alongside the mount portion, the inner portion having a first wing extending away from the cooking chamber and that contacts and seals against the inner surface of the door at a second location. In another aspect of the previous embodiments, the inner portion of the gasket includes a second wing extending into the cooking chamber. In another aspect, the mount portion includes a metal insert and a hollow cavity behind the outwardly-facing domed portion. In another aspect of the previous embodiment, the metal insert includes a generally planar mid-portion with two wing portions that extend outward away from the oven and that are angled toward each other. In another aspect of the previous embodiments, multiple fasteners engage the metal insert to mount the gasket to the oven housing.

In another aspect of the previous embodiments, the gasket includes a second wing portion extending into the cooking chamber, wherein sprayed water impinging upon the inner surface of the door contacts the first wing portion and flows along the inner surface of the gasket to the second wing portion and back into the cooking chamber. In another aspect of the previous embodiments, the gasket has a mount portion with an outwardly domed part that contacts the inner surface of the door at a location spaced from the first wing portion. In another aspect, the outwardly domed part of the gasket is movable away from a planar part that seats against the oven housing for mounting.

In another aspect of the previous embodiments, the oven includes a cooking chamber with an access opening and a door movable between an open position(s) and a closed position relative to the access opening. The door includes an inner glass pane and an outer glass pane. The inner glass pane is rigidly mounted to a frame of the door for movement therewith, and the outer glass pane is movably mounted to the frame. In another aspect of the previous embodiment, the outer glass pane has a closed condition lying alongside but spaced apart from the inner glass pane, and an open condition in which the outer glass pane is pivoted outward away from the inner glass pane. In another aspect of the previous embodiments, the outer glass pane can be moved from the closed condition to the open condition while the door remains in its closed position. In another aspect, the outer glass pane is mounted on a secondary frame member that is pivotally attached to the frame of the door. In another aspect, the door includes a latch for securing the outer glass pane in the closed condition. The latch is one of a magnetic latch or a manual latch. In another aspect of the previous embodiments, the oven includes a gasket positioned between the door and a housing of the cooking chamber, and the inner glass pane abuts against the gasket when the door is in the closed position.

In another aspect of the previous embodiments, the inner glass pane is rigidly mounted to a primary frame of the door that is pivotably mounted to a housing of the oven, and the outer glass frame is mounted to a secondary frame that is pivotably mounted to the primary frame. In another aspect, the oven includes a releasable latch mechanism between the secondary frame and the primary frame for holding the outer glass pane in the closed condition.

According to another aspect of any of the previous embodiments, the oven includes a steam input arrangement within the cooking chamber.

The details of one or more embodiments are set forth in the accompanying drawings and the description below. Other features, objects, and advantages will be apparent from the description and drawings, and from the claims.

DETAILED DESCRIPTION

Figure 1:
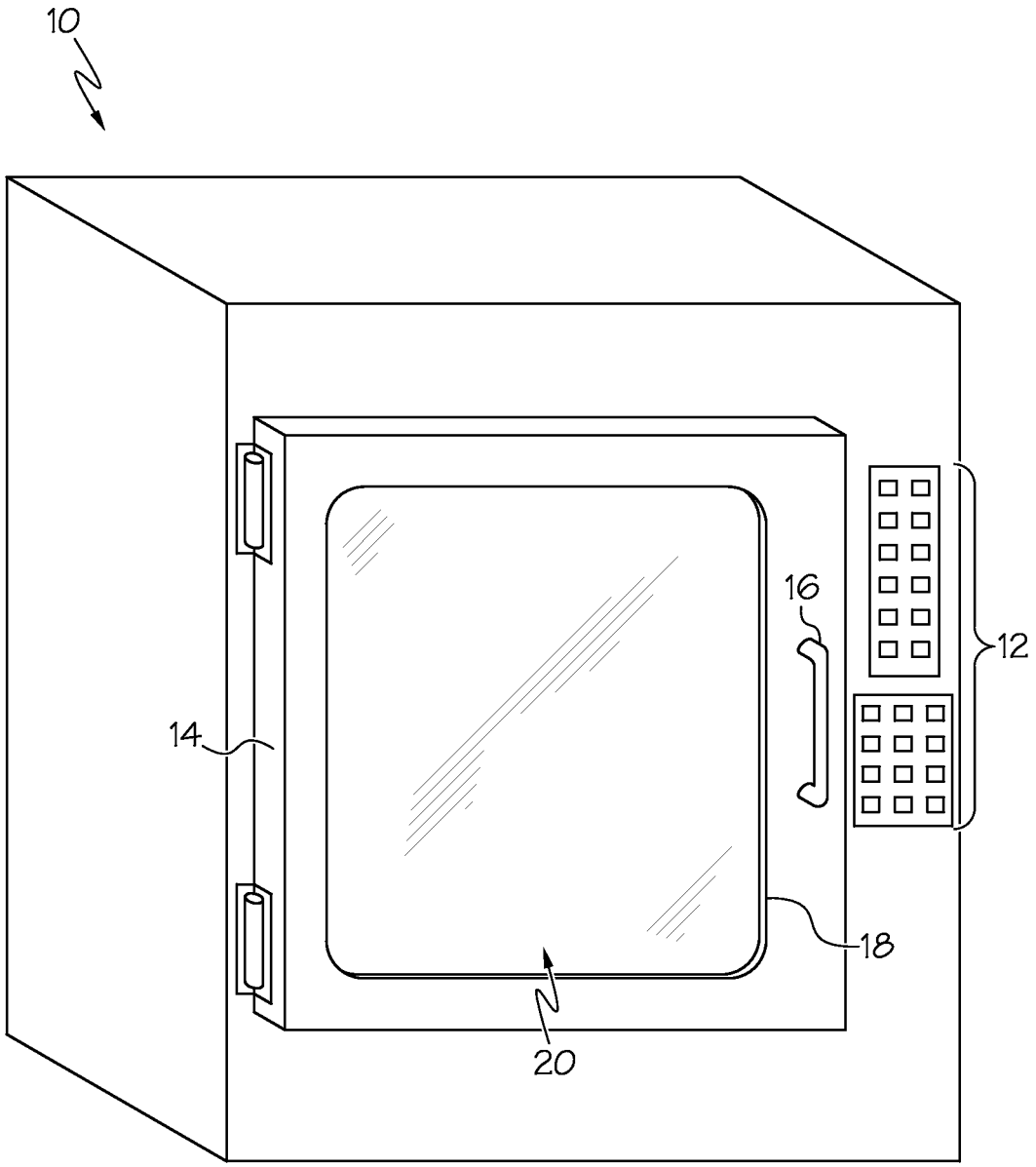
FIG. 1 is a perspective view of an oven.

Referring to FIG. 1, an exemplary oven 10 is shown. The oven 10 includes a control interface 12, which may include a variety of components, such as an information display area, a numeric keypad, ON/OFF buttons/keys, function specific buttons/keys, and/or various indicator lights. The oven 10 includes a hinged access door 14 with a handle 16 and glass area 18 for viewing the internal cooking chamber 20. In one embodiment, the door 14 may be vertically hinged so that the door 14 pivots horizontally. The door 14 is generally movable between a closed position and one or more open positions relative to an access opening to the internal cooking chamber 20. In one example, the oven 10 is a type that includes a heating source (e.g., electrical or gas-powered), a blower for moving air past the heating source, and a steam generation system. In one embodiment, stationary, removable racks may be located in the cooking chamber 20, while in another embodiment a movable food supporting structure (e.g., a rack rotation mechanism) may be located within the cooking chamber 20.

Figure 2:
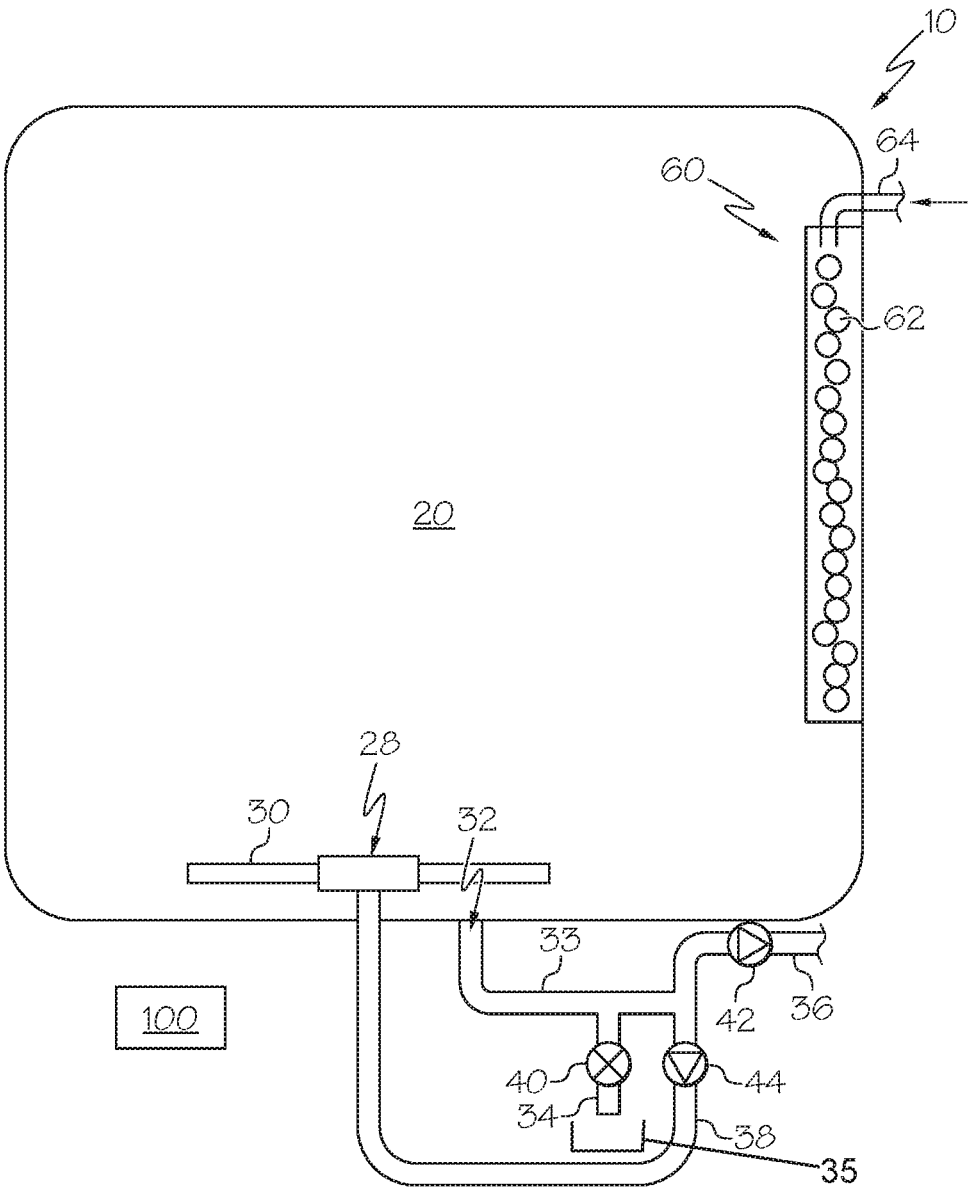
FIG. 2 is a schematic depiction of the oven of FIG. 1 with an associated drain and cleaning flow arrangement and a steam input arrangement.

As shown in the schematic of FIG. 2, the oven 10 also includes an internal spraying system 28 for cleaning purposes. In one embodiment, the spraying system 28 is formed by a rotatable spray arm 30 with multiple nozzles thereon, located at the bottom of the cooking chamber 20. However, stationary spray systems 28 could also be used, and the location of the spray system varied. As shown in FIG. 2, the bottom of the cooking chamber 20 is configured to direct liquid flows toward a drain 32 which may have a cover screen. In this regard, liquids in the oven 10 will tend to move under gravity toward the drain 32, including liquids from the spray cleaning system (spraying system 28), liquids from any steam that condenses within the oven 10, and liquids generated directly by cooking foods (e.g., water, oils and grease that come out or off of heated food products). Thus, drain 32 acts as a universal drain for all such liquid flows. The universal drain 32 can deliver such flows along a common flow path 33 (referred to herein, in the alternative, as the chamber drain flow path) and then to any of a grease drain path 34 (e.g., that leads to a grease collecting compartment or container 35), a water drain path 36 (e.g., that leads to a municipal drain system or septic), or a water recirculation path 38 (e.g., leading back to the spray nozzles within the cooking chamber 20). A valve 40 controls flow along the grease drain path 34, a drain pump (or drain valve) 42 controls flow along water drain path 36, and a wash pump 44 controls flow along water recirculation path 38.

Figure 3:
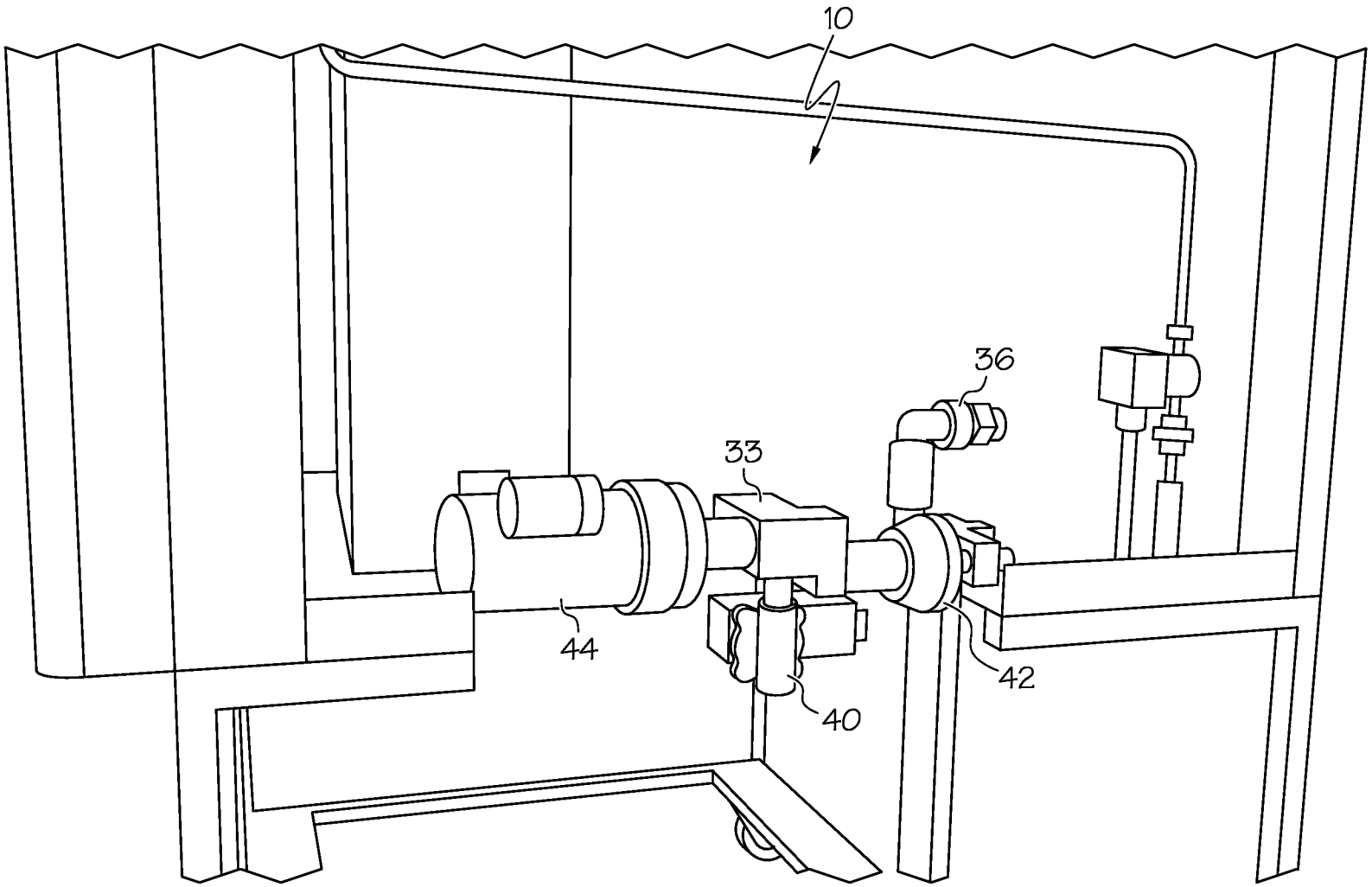
FIGS. 3-6 are partial perspective views of various aspects of a drain and cleaning flow arrangement of the oven of FIGS. 1-2.
Figure 4:
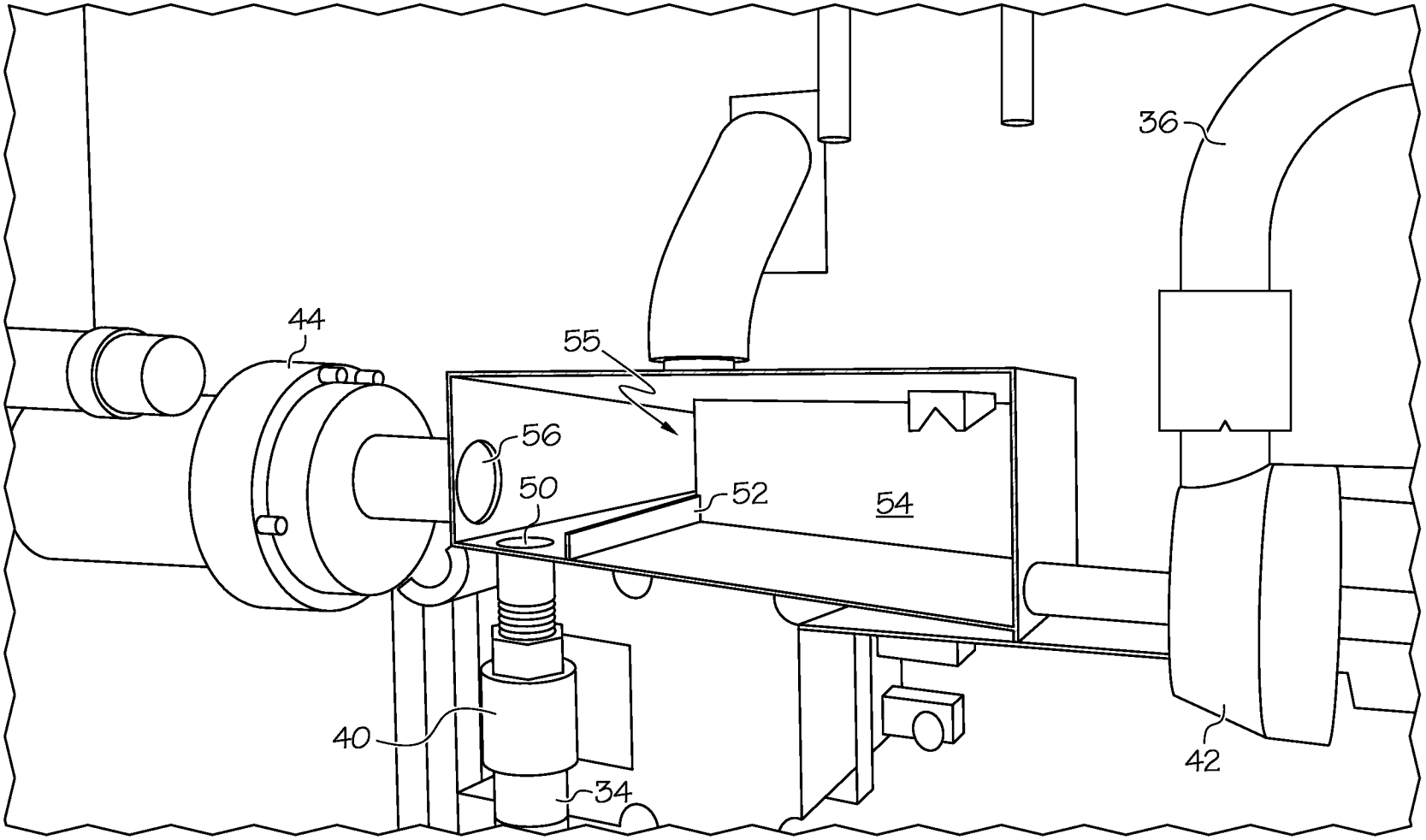

Referring now to FIG. 3, the valve 40 and pumps 42, 44 are shown in a perspective view, all located toward the end of the common flow path 33. As seen in FIG. 4, a grease drain opening 50 (e.g., second opening relative to first opening 55 described below) is located in the floor of the common flow path 33, and a baffle wall 52 is located at the side of the end of the common flow path 33 so that liquid must pass over the baffle wall 52 to reach a compartment or chamber 54 (external of the cooking chamber 20) that feeds to the drain pump 42. The baffle wall 52 extends upward from the floor/bottom of the common flow path 33 to define a first opening 55 in the common flow path 33 above the baffle wall 52 that leads to chamber 54, drain pump 42, and into the water drain path 36. The first opening 55 in the common flow path 33 is elevated or raised above the grease drain opening 50. The baffle wall 52 restricts the flow of grease from the common flow path 33 to chamber 54 and the drain pump 42. Liquid in the common flow path 33 must travel over the baffle wall 52 to reach the chamber 54 and the drain pump 42. A third opening 56 leading to the wash pump 44 and the water recirculation path 38 is also elevated above the bottom of the common flow path 33 and the grease drain opening 50 therein.

Figure 5:
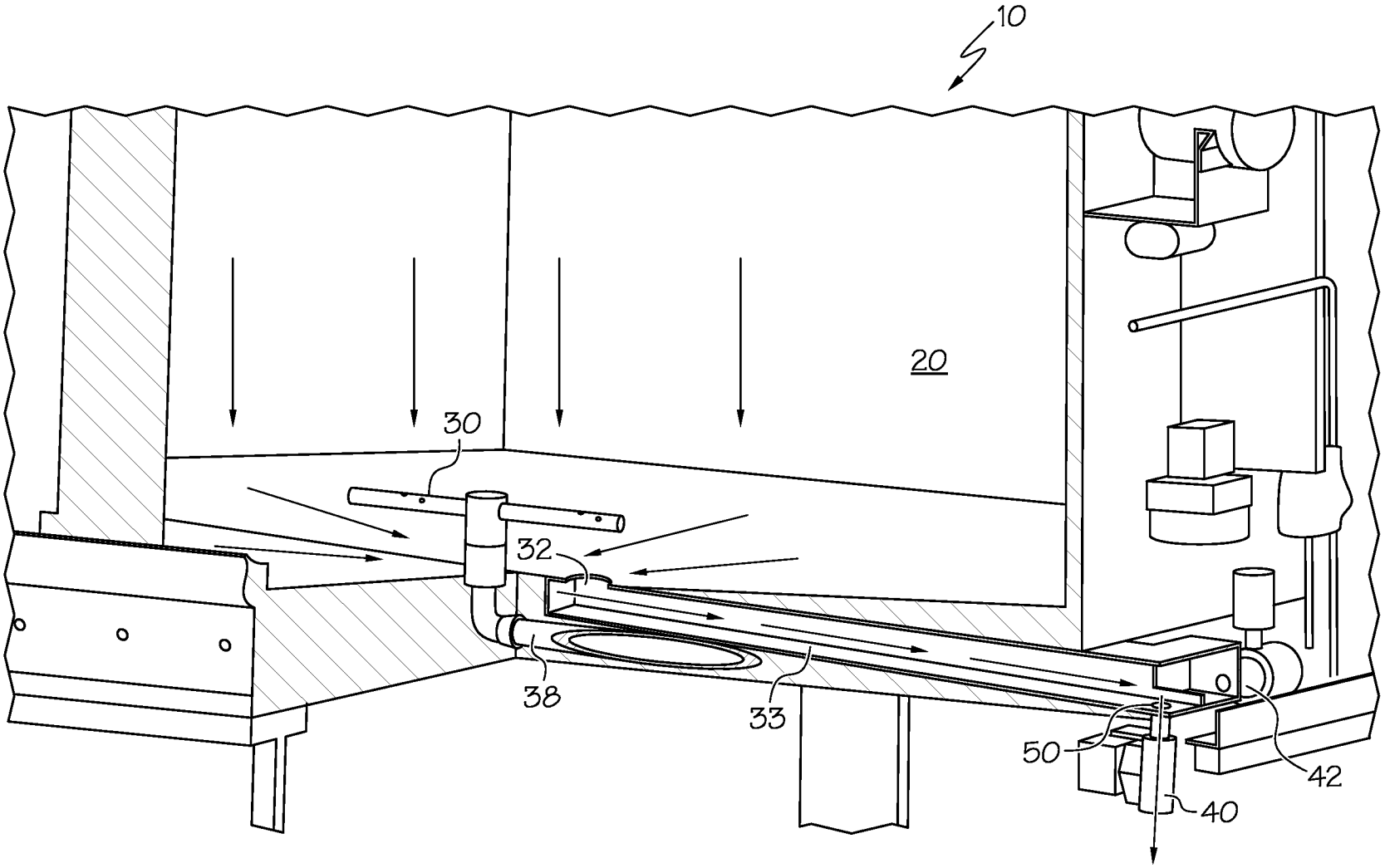

Referring to FIG. 5, during a cooking operation, grease flows from the cooked food product, under the force of gravity, down the drain 32, along common flow path 33, which angles downwardly, and into the grease drain opening 50. The valve 40 is maintained open during cooking operations so that the grease flows will flow down the grease drain opening 50 and into the downstream container or compartment (not shown). All grease flows to the grease container or compartment are under gravity flow, eliminating any need for use of a grease pump, which would be subject to clogging and mechanical degradation due to the grease. The baffle wall 52 extends high enough to prevent the grease flows from passing over during the cooking operation, thereby inhibiting undesired grease flows toward the drain pump 42. Both the drain pump 42 and wash pump 44 are generally off during the cooking operations.

Figure 6:
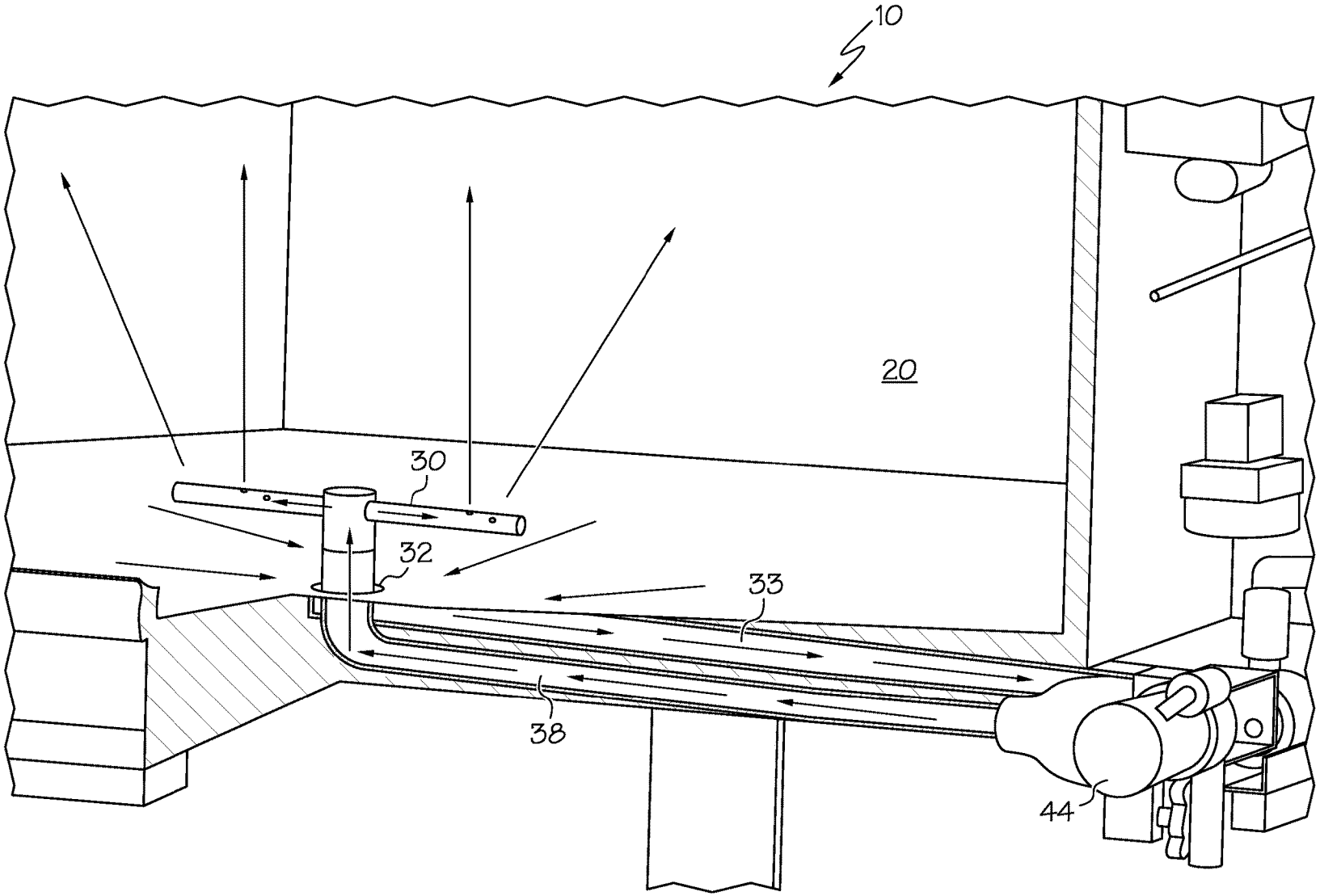
Figure 7:
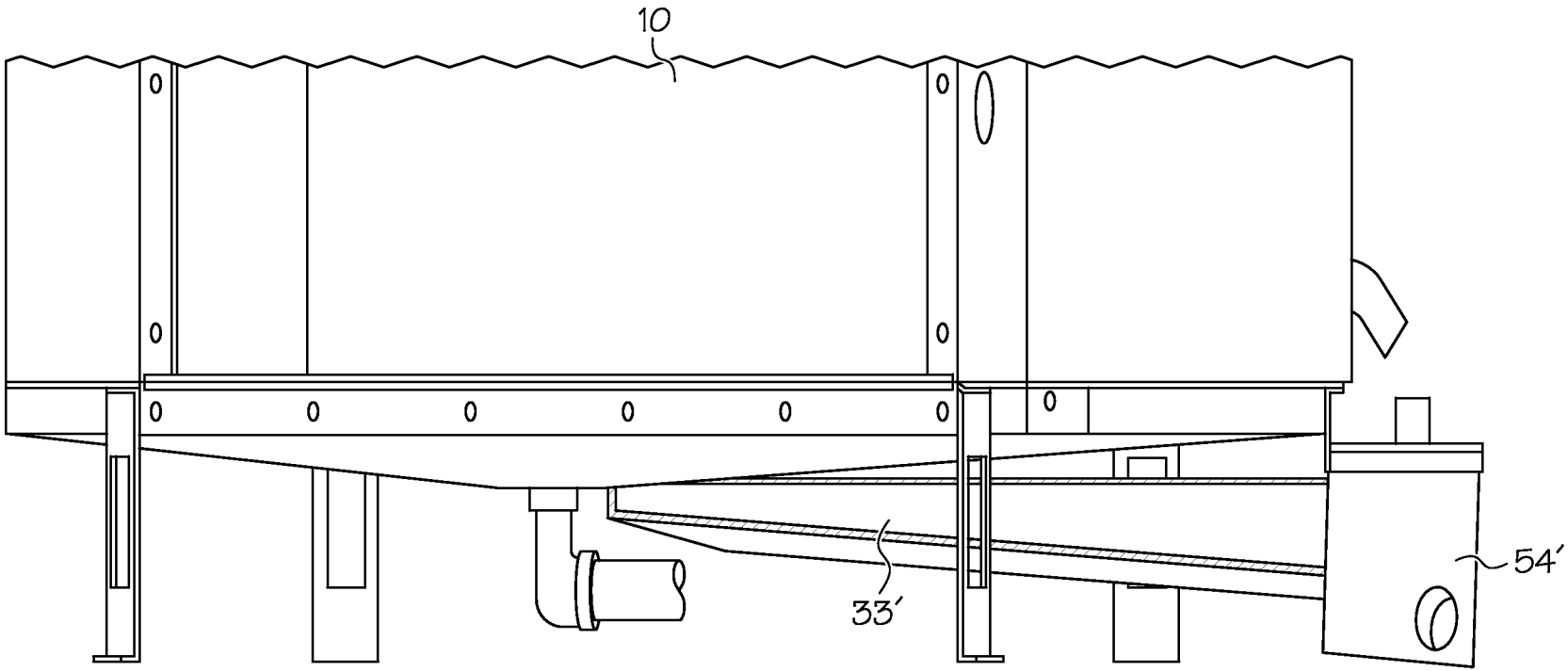
FIGS. 7-11 are partial perspective views of various aspects of an alternative embodiment of a drain and cleaning flow arrangement for the oven of FIGS. 1-2.
Figure 8:
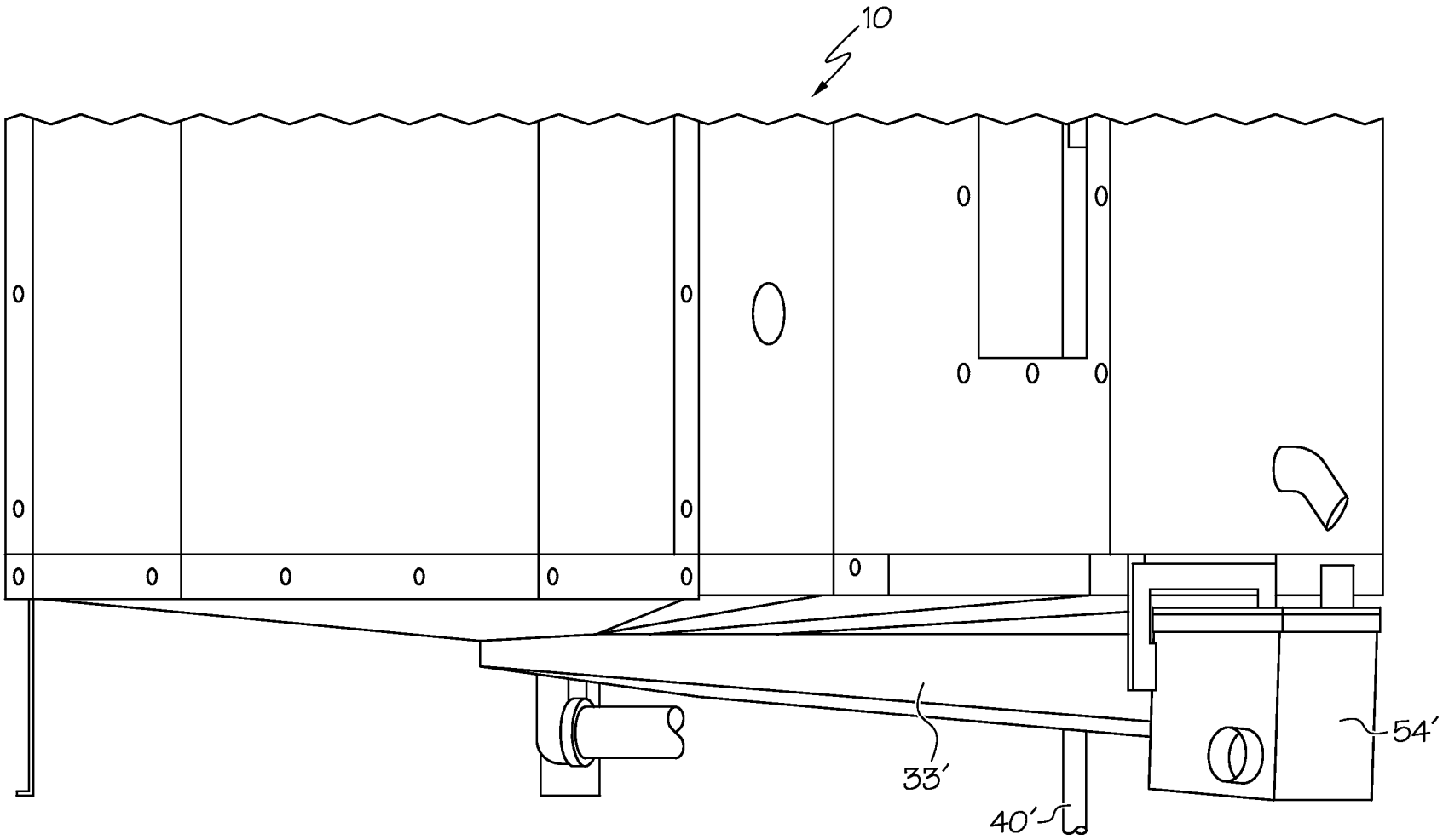
Figure 9:
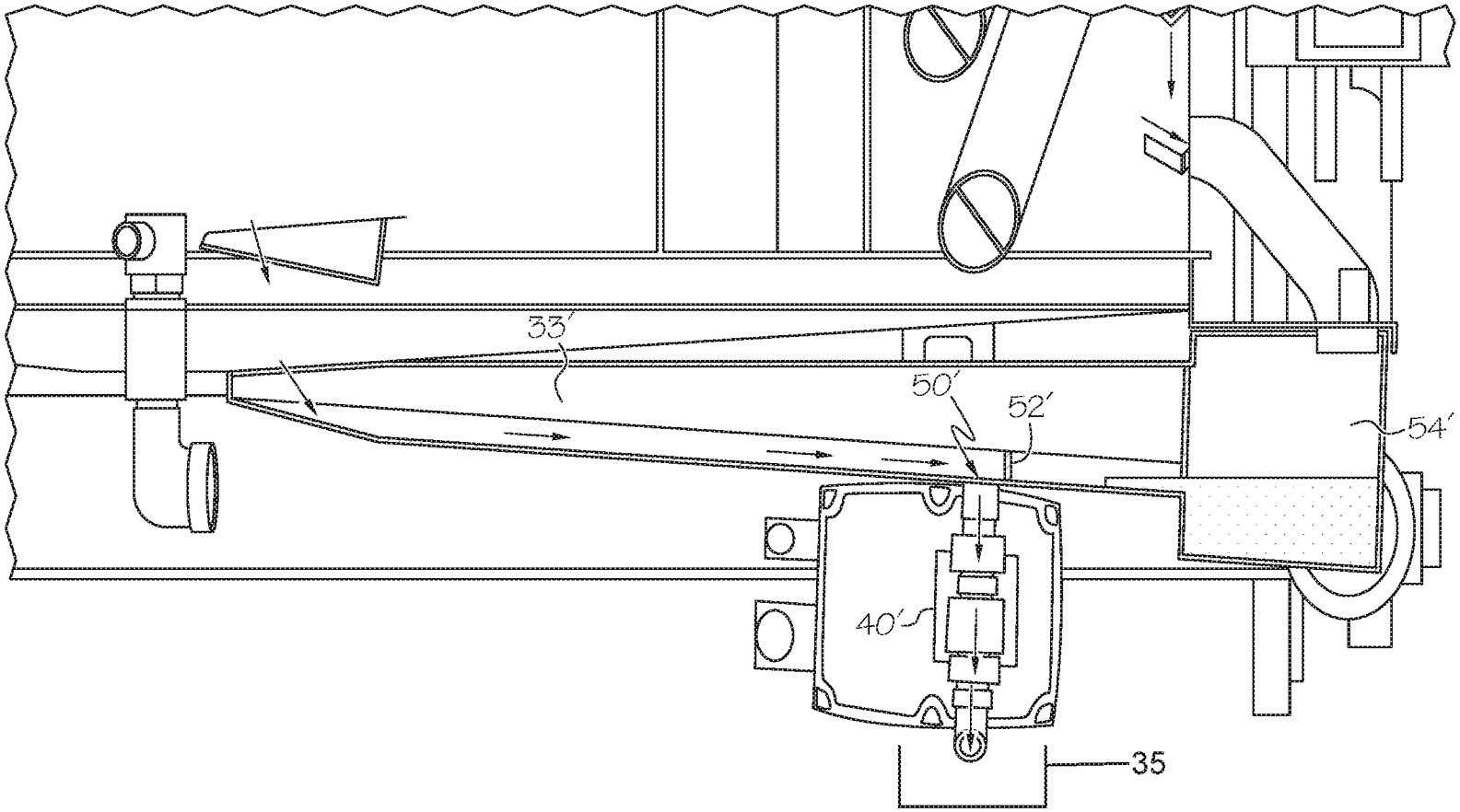
Figure 10:
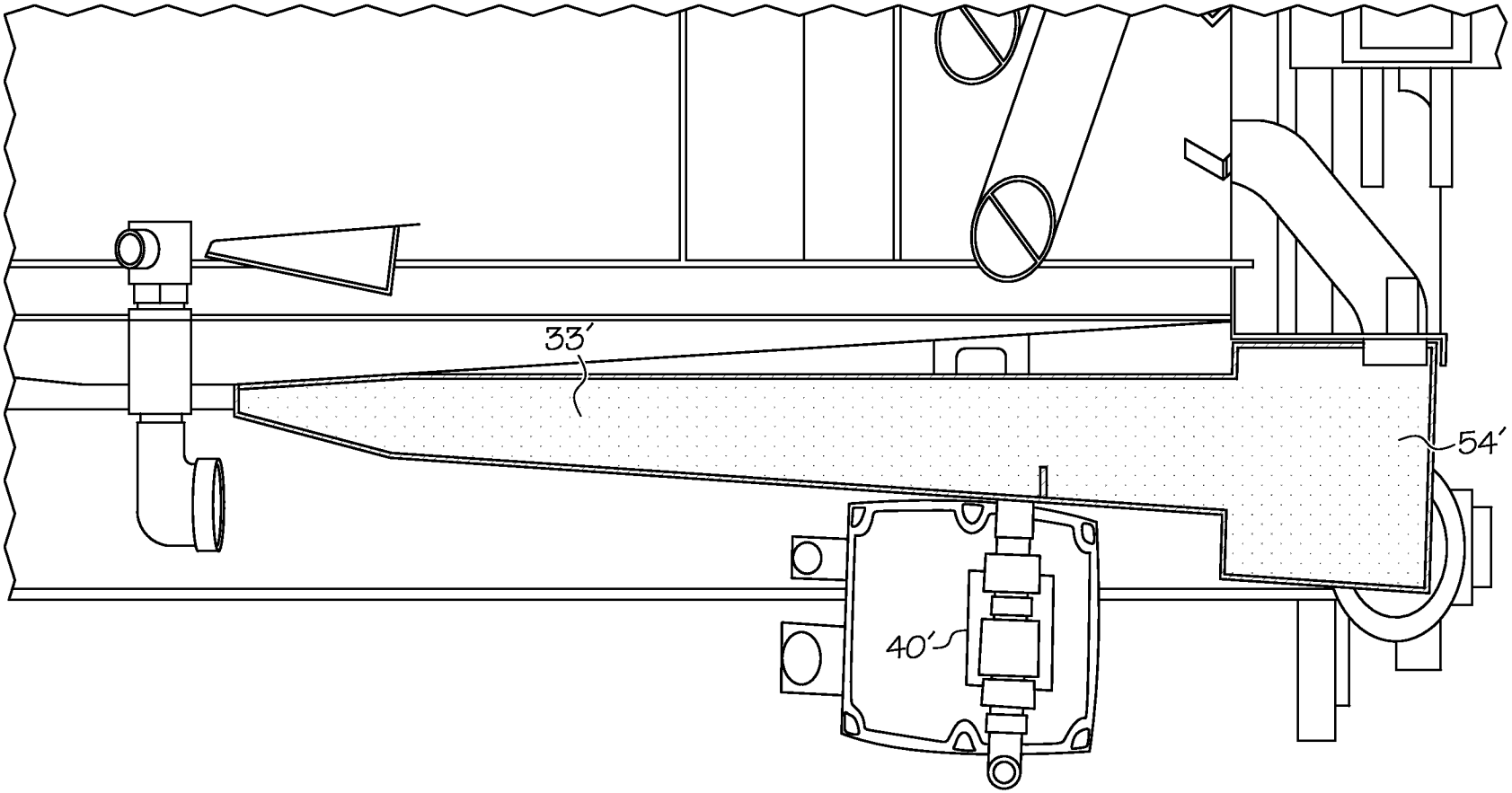

When it is desired to initiate a cleaning operation, the valve 40 is closed and liquid sprayed within the chamber will pass through drain 32, along path 33, and then through opening 56 to the wash pump 44 that delivers the cleaning liquid back along path 38 to the spray arm 30 for further spraying, per FIG. 6. The drain pump 42 is off during this operation.

To bring the cleaning operation to a close, the wash pump 44 is turned off, and the drain pump 42 is turned on to pump the cleaning liquid and any material therein to the municipal drain. The grease drain valve 40 remains closed. In some embodiments a clean rinse spray may subsequently be initiated, with flows from the rinse also being delivered to the drain pump 42. Once the cleaning operation, including any associated rinse, is complete, the pump 42 is turned off, and the grease drain valve 40 may be opened for future cooking operations. The oven 10 may also include a controller 100 (shown schematically in FIG. 2) configured to control the valve 40, the drain pump 42, the wash pump 44, or combinations thereof in order to accomplish the aforementioned cooking operations and/or cleaning operations, or steaming operations utilizing a steam input arrangement. In some embodiments, the controller may also control other functions of the oven.

Figure 11:
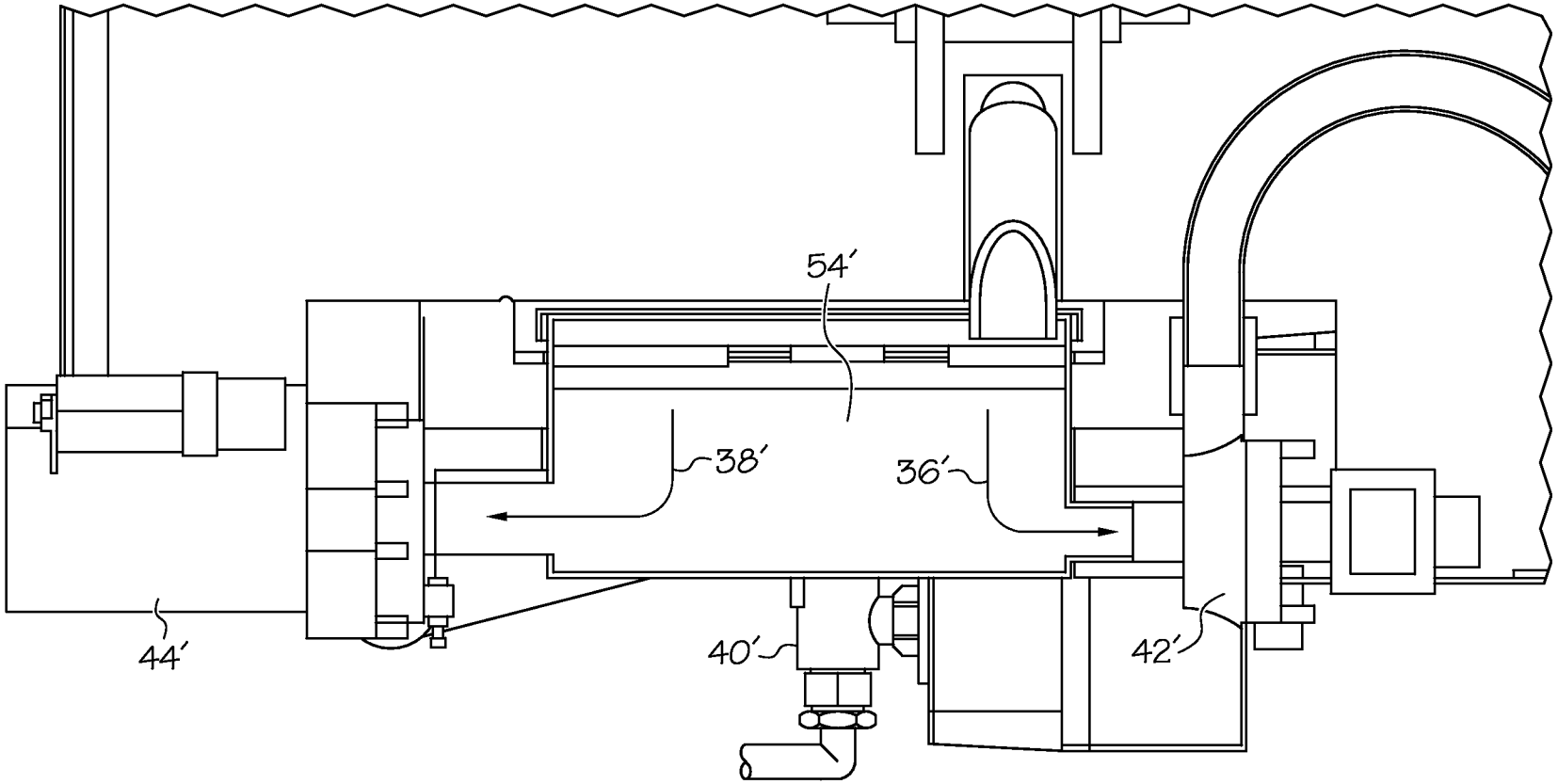

In the alternative embodiment of FIGS. 7-11, the chamber 54' is located at the end of the common flow path 33'. The baffle wall 52' is located downstream of the grease drain opening 50' and upstream of the chamber 54'. The drain pump (or drain valve) 42' and the wash pump 44' are located on opposite ends of the chamber 54'. During cooking, per FIG. 9, the grease drain valve 40' is open and the baffle wall 52' prevents grease from traveling to the chamber 54'. During wash water recirculation, the grease drain valve 40' is closed and water fills the common flow path 33', per FIG. 10, and enters the chamber 54', where it is delivered to the wash pump 44' for recirculation. As shown in FIG. 11, the recirculation path 38' extends from chamber 54', through one end (e.g., left side in reference to the paper upon which FIG. 11 is printed) of the chamber 54', and to the wash pump 44', which returns wash liquids to the spray arm 30. At the conclusion of a wash cycle, the wash pump 44' is stopped and the drain pump 42' is started to direct liquids through the water drain path 36'. In FIG. 11, the water drain path 36' extends from chamber 54', through an opposing end (e.g., opposite the recirculation path 38' and to the right in reference to the paper upon which FIG. 11 is printed) of the chamber 54' opposite the recirculation path 38', and to the drain pump 42'.

Referring back to FIG. 2, the cooking chamber 20 of the oven 10 may also include a steam input arrangement 60, which may be formed by a mass of metal 62, which acts as a heat accumulator, and onto which water is delivered by a water input path 64 in order to generate steam. By way of example, the metal mass may be similar to that described in U.S. Pat. No. 6,516,712, but variations are possible. Any incoming water that is not converted to steam passes to the bottom of the steam input arrangement 60 and is delivered out of the cooking chamber 20.

During steaming operations, as well as during cleaning operations, it is generally desirable to assure that the oven door 14 remains closed. A positive latching feature is provided for this purpose.

Figure 13:
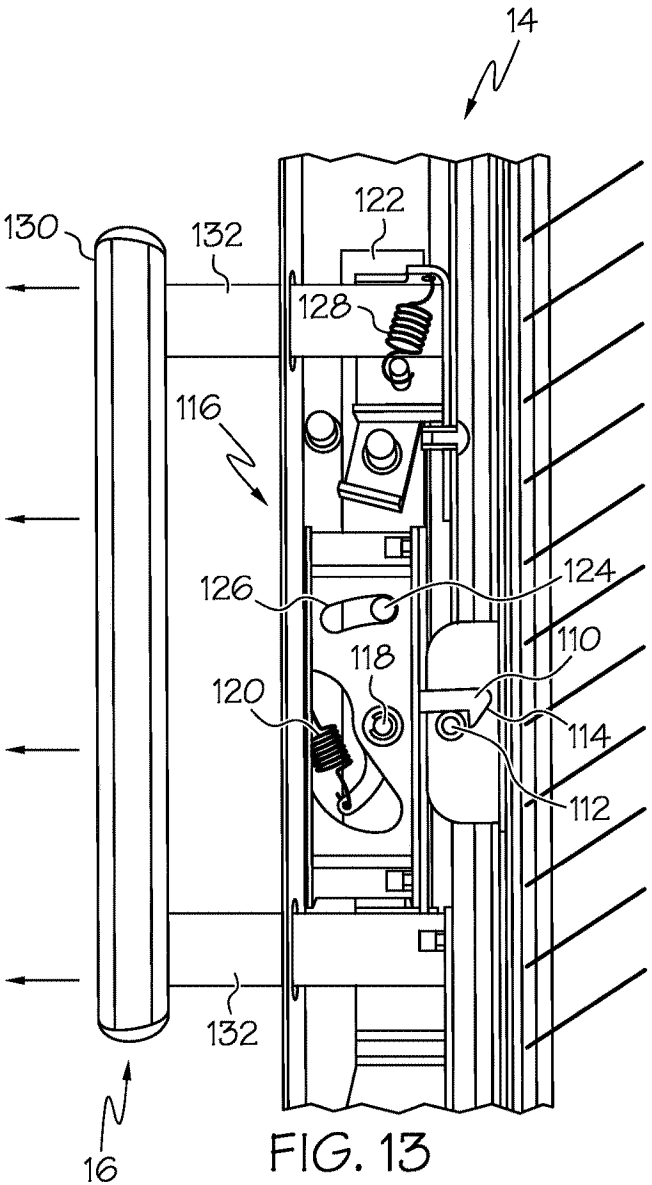
FIG. 13 is a side view of the latch mechanism for the door depicted in FIG. 12.
Figure 12:
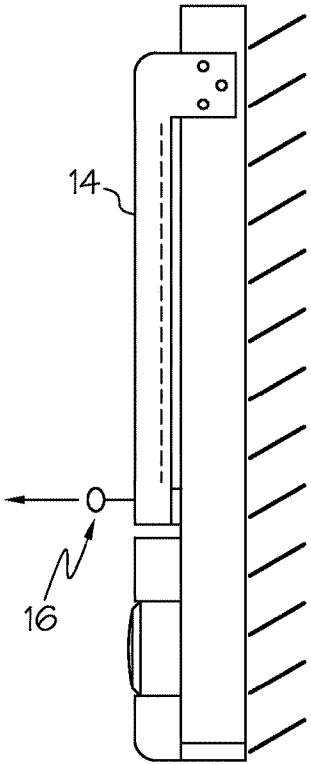
FIG. 12 is a top view of a door of the oven of FIGS. 1-2.

Referring to FIGS. 12 and 13, the oven 10 includes a positive latch member 110, shown engaged with a pin 112. The latch member 110 includes a ramped surface 114 (or cam surface) that contacts the pin 112 when the door 14 is being pushed closed, such that the latch member 110 automatically shifts toward its unlatched state during door closure, and then moves back to the illustrated latching position to hold the door 14 closed. Engagement of the latch member 110 with the pin 112 to latch the door 14 in the closed position occurs automatically upon closure of the door 14 without further engagement by the user. To open the door 14, the handle 16 is simply pulled straight away from the door, which causes the retaining portion of the latch member 110 to move clear of the pin 112, allowing the door to be pulled open. A biased linkage system 116 may facilitate this operation.

In one embodiment, the latch member 110 is mounted for pivotable movement about a point 118, with a spring member 120 biasing the latch member 110 into the latching position. Pulling the handle 16 outward away from the door causes a linkage 122 to move to the left (e.g., relative to the page on which FIG. 13 is printed) with the travel of the linkage 122 controlled via an associated pin 124 and slot 126 arrangement. The movement of linkage 122 causes the latch member 110 to pivot to its unlatch position. Upon release of the handle 16, a biasing spring 120 causes the handle to move back toward the door into its normal position.

The spring 128 acts as a handle debounce assist. When the door is closed the latch member 110 temporarily pivots out of its latching position during interaction with the pin 112. However, the spring 128 keeps the handle member 16 in a stable position near the plane of the door during the temporary latch movement to aid in assuring that the door does not kick back open.

Notably, the grip portion 130 of the handle maintains a consistent orientation relative to the door 14 when the handle 16 is pulled away from the door 14 (e.g., in the illustrated case an axis of the grip portion remains generally parallel to the outer surface of the door 14). The spaced apart arms 132 extending from the grip portion 130 extend into the door 14 to provide connection with the linking arrangement. The arms 132 also maintain their respective orientations relative to the door 14 when the handle 16 is moved (e.g., in the illustrated case the axes of the arms 132 remain generally perpendicular to the outer surface of the door).

The positive latch member 110 helps maintain good sealing contact between a gasket and the door. During cleaning operations, it is generally desirable to assure that sprayed liquids are retained within the cooking chamber. A gasket arrangement is provided for this purpose.

Figure 14:
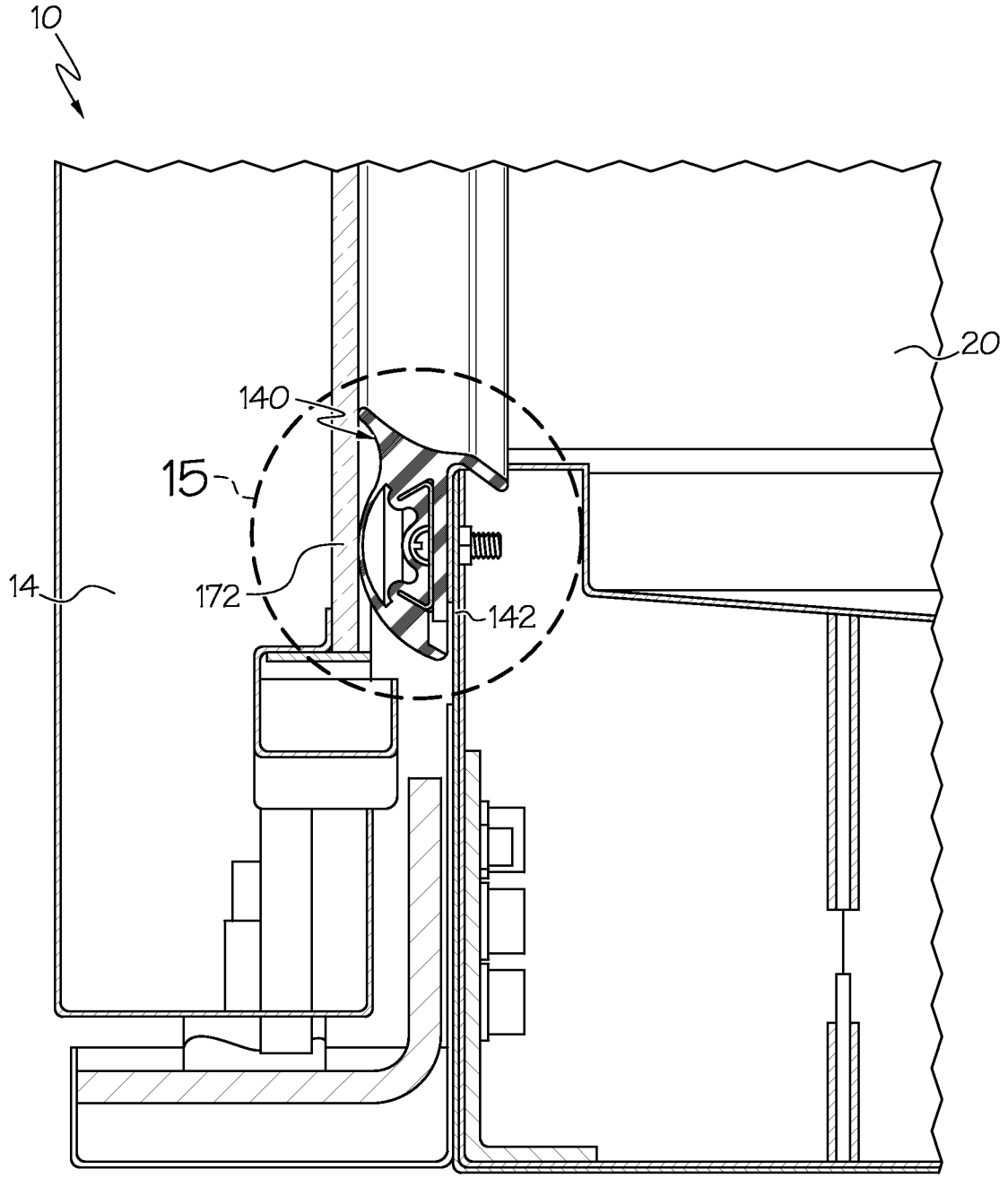
FIGS. 14-15 are partial side views, with a portion cut away, of a door gasket/seal arrangement for the ovens of FIGS. 1-13.
Figure 15:
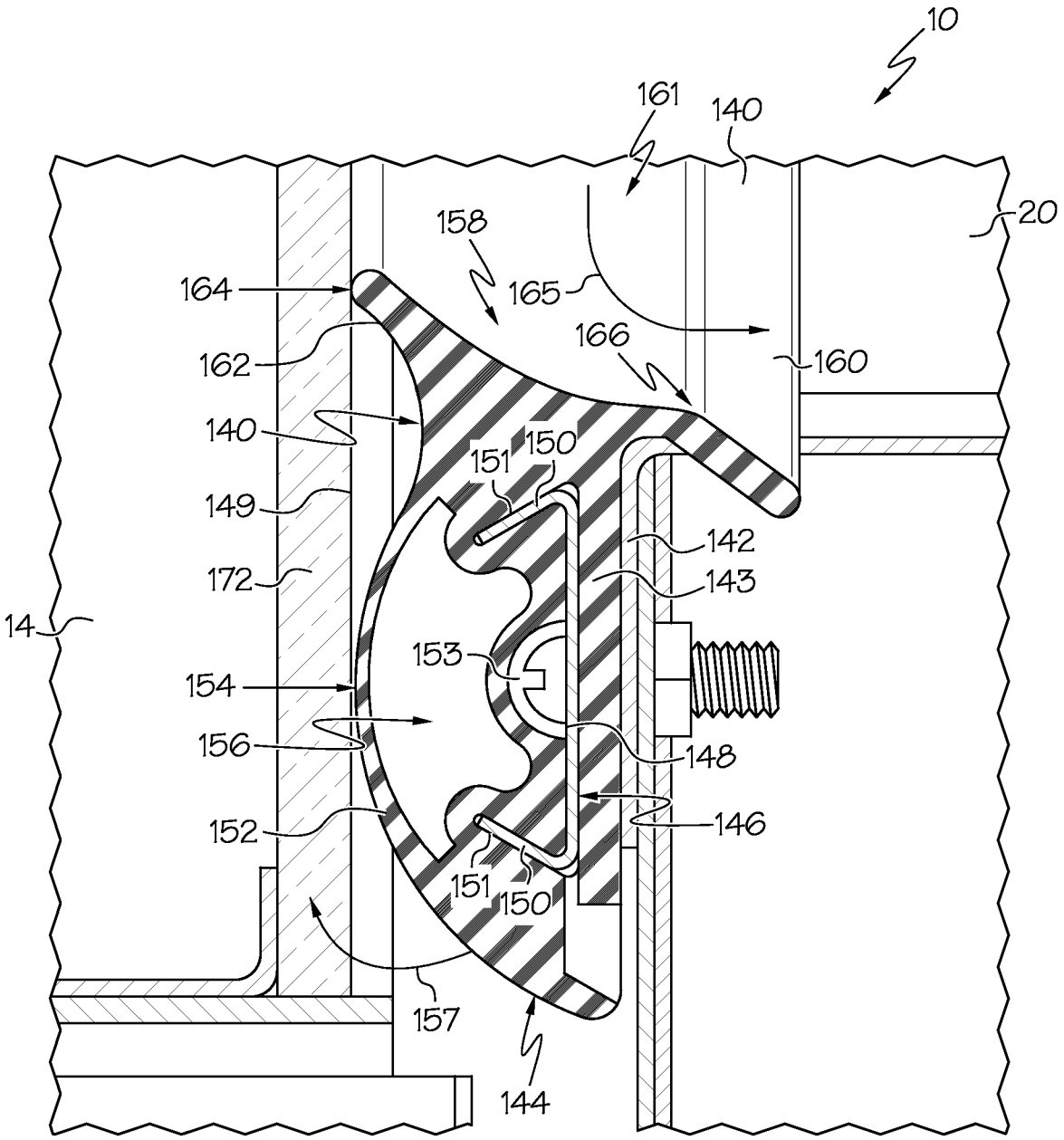

Referring to FIGS. 14 and 15, a gasket 140 is positioned between the oven door 14 and the oven housing frame 142. In the illustrated embodiment, the gasket 140 is mounted to a surrounding oven housing frame 142 of the access opening to the oven cooking chamber 20. The gasket 140 includes an outer mount portion 144 positioned alongside the access opening and having a metal insert 146 to provide rigidity thereto and for fastener attachment. The metal insert 146 includes a generally planar mid-portion 148 with two wing portions 150 that extend outward away from the oven 10 and that are angled slightly toward each other. Corresponding slots 151 formed internally of the gasket 140 hold the two wing portions 150 of the metal insert 146. The gasket 140 may be an extruded member with slots 151 formed for the metal insert 146 to be added later. An outwardly domed side 152 of the mount portion 144 abuts against the inside surface 149 of the oven door 14 (e.g., an inside surface of a glass plate of the door 14) when closed in order to provide one line of sealing contact with the door 14 at a first position 154. A partially hollow interior cavity 156 allows the domed side 152 to flex slightly when contacted by the oven door 14.

Notably, the outwardly domed side 152 of the mount portion 144 can be folded upward away from the metal insert 146 and a planar gasket part 143 (e.g., per arrow 157) to provide access to the metal insert 146 for the purpose of placing bolts or other fasteners through the metal insert 146 and into the housing frame 142 to secure the gasket 140 in place. The outer domed side 152 is then folded back down to engage the slots 151 with the wing portions 150 and hold the outer domed side 152 down in its normal operating position. An internal space 153 is provided to receive the bolt heads.

An inner portion 158 of the gasket 140 is positioned alongside the mount portion 144 and includes an inwardly extending wing 160 and an outwardly extending wing 162. The outwardly extending wing 162 contacts the inside surface 149 of the door 14 when closed to provide another line of sealing contact at a second position 164 spaced apart from the first position 154 (i.e., the first position 154 is spaced apart from the outwardly extending wing 162). The outwardly extending wing 162 flexes slightly when contacted by the door 14 for this purpose. The inwardly extending wing 160 extends slightly into the cooking chamber 20 and abuts against the rim of the cooking chamber access opening (e.g. at corner 166). Water that is sprayed onto and impinges the oven door 14 falls under gravity onto outwardly extending wing 162, then along the inwardly facing surface 161 of the gasket 140 to inwardly facing wing 160, thereby causing the water to be redirected back into the cooking chamber 20 (e.g., see arrow 165). This arrangement prevents buildup of wash water on top of the seal by the door 14, thereby avoiding undesired release of any such water when the door 14 is opened.

Figure 16:
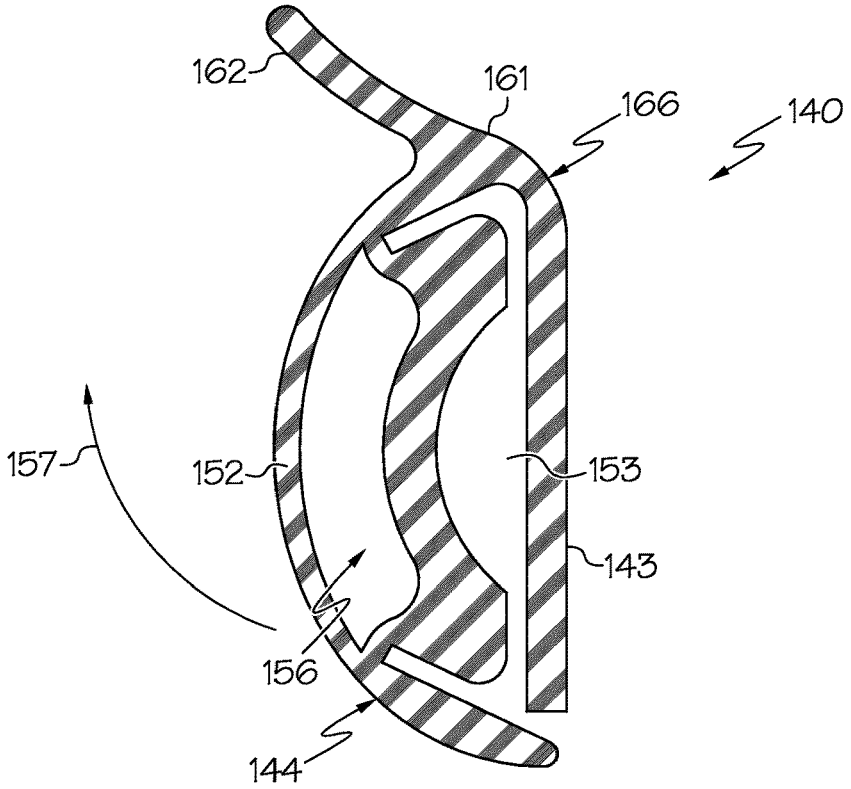
FIG. 16 is a side sectional view of another embodiment of a door gasket/seal arrangement for use with the ovens of FIGS. 1-13.
Figure 17:
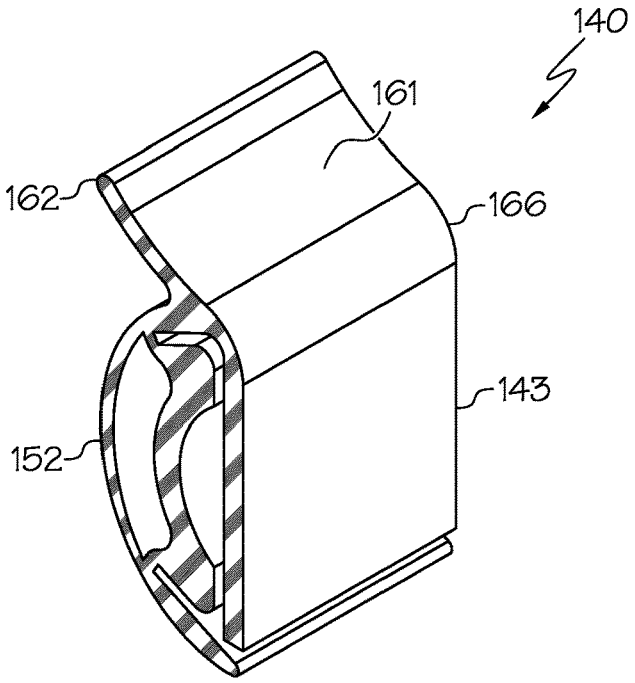
FIG. 17 is a perspective view of the door gasket/seal arrangement of FIG. 16.

In an alternative embodiment, the inwardly extending wing 160 could be shortened or eliminated, with the gasket 140 terminating at or near the corner 166. FIGS. 16 and 17 depict such an embodiment, where the metal insert 146 has not yet been placed into the gasket 140. Moreover, the planar gasket part 143 of such gasket could also be eliminated, in which case the metal insert would abut directly against the housing frame 142 when the gasket is installed on the oven.

Figure 18:
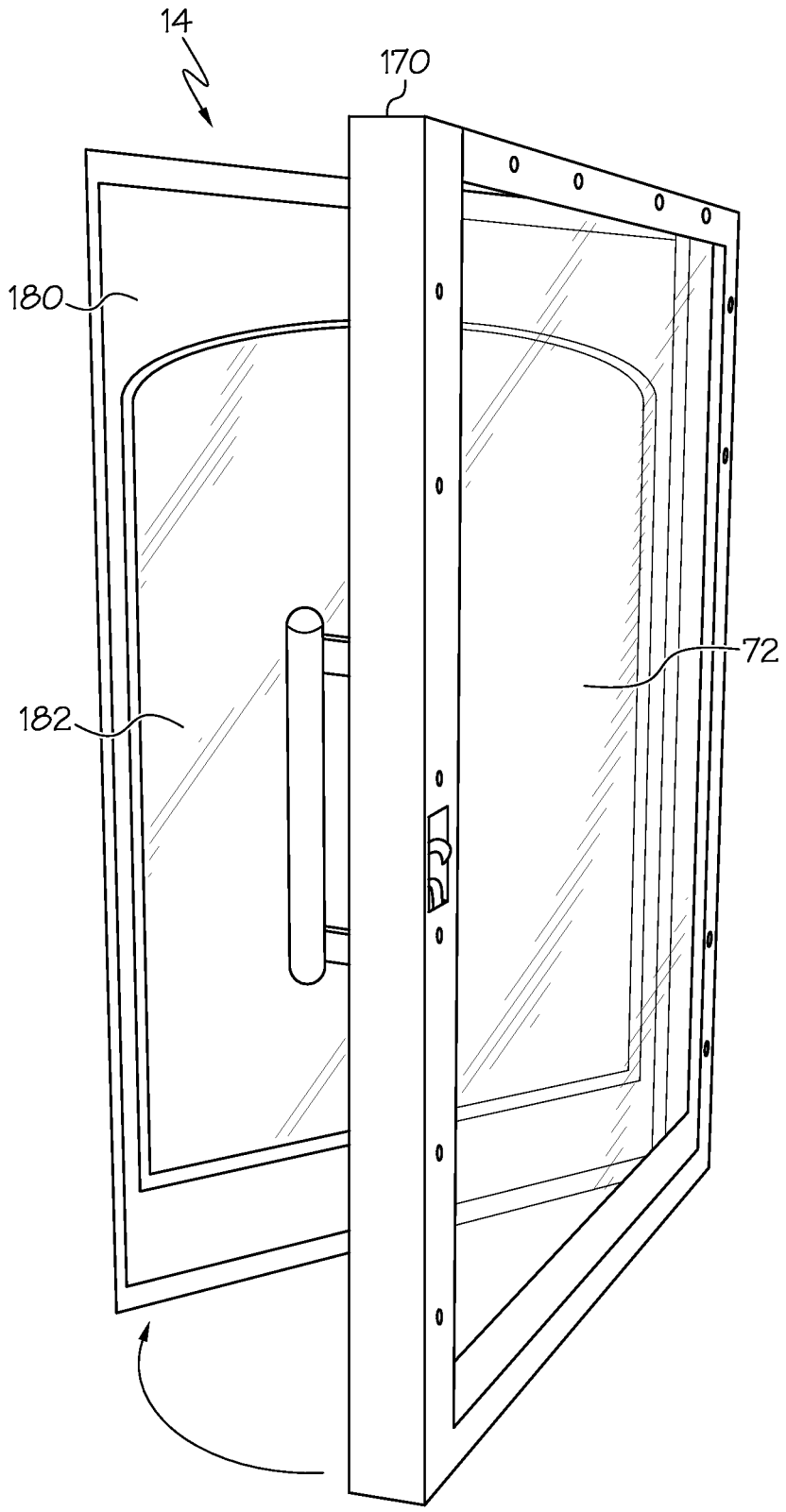
FIGS. 18-19 are partial perspective views of an oven door assembly for the ovens of FIGS. 1-17.
Figure 19:
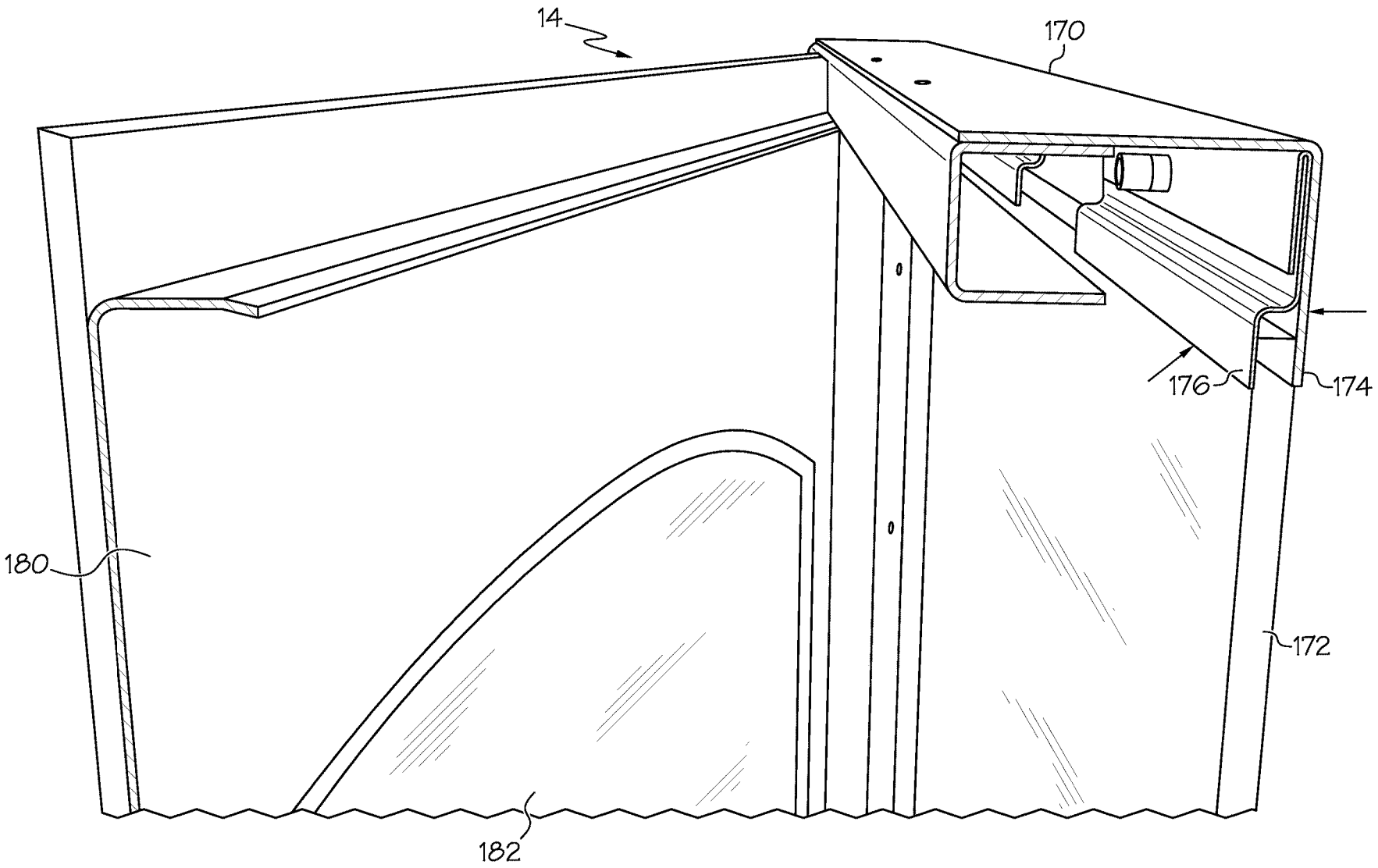

As seen in FIGS. 18 and 19, in one embodiment the door 14 includes a frame 170 that is pivotably mounted to the oven housing frame 142. An inner glass pane 172 is mounted to the frame 170 (e.g., between inner retaining flanges 174 and outer retaining flanges 176). Thus, the inner glass pane 172 is rigidly positioned on the door frame 170 for movement therewith. When the door 14 is in the closed position and the inner surface of the inner glass pane 172 abuts against the gasket 140 as shown in FIG. 14, the rigid mounting of the inner glass pane 172 helps to assure consistent, even pressure against the gasket 140. By contrast, in the previously known door configurations in which an inner glass pane is movably mounted to the pivoting door frame, gasket pressure against the door glass could cause bowing of the inner door glass, resulting in uneven gasket pressure and an increase in the likelihood of steam and water leakage.

The door 14 includes an outer, secondary frame 180 that is pivotably mounted to the door frame 170 (e.g., secondary frame 180 is secondary to the door frame 170, which is the primary frame). The secondary frame 180 carries an outer glass pane 182 that is spaced apart from the inner glass pane 172 when the secondary frame 180 is positioned against/alongside the frame 170 in a closed condition. The secondary frame 180 swings open as shown to provide access between the inner and outer glass panes 172, 182 for cleaning purposes. In the open condition, the outer glass pane 182 is pivoted outward away from the inner glass pane 172. Notably, the secondary frame 180, including the outer glass pane 182, may be swung open even when the door 14 is in the closed and latched position relative to the oven housing 142. In this regard, a magnetic latch, quick slider type latch, or other manual latch may be used to hold the secondary frame 180 against the door frame 170 during normal use of the door 14, but enabling ready operator release of the latch (e.g., either by pulling the secondary frame 180 to overcome the magnet force or by manually operating the slide latch) to swing the secondary frame 180 away from the door frame 170.

It is to be clearly understood that the above description is intended by way of illustration and example only, is not intended to be taken by way of limitation, and that other changes and modifications are possible.

What is claimed is:

1. An oven, comprising:

a cooking chamber;

a spray system for spraying cleaning fluid in the cooking chamber; and a chamber drain flow path that leads to each of a grease drain path, a water drain path and a water recirculation path of the spray system, wherein the water drain path includes an associated drain pump or drain valve, the water recirculation path includes an associated wash pump and the grease drain path lacks a drain pump and flow along the grease drain path is controlled by a controllable valve;

wherein the grease drain path leads to a grease collecting compartment or container;

wherein the water drain path leads externally of the oven;

a grease drain opening positioned in the chamber drain flow path and leading to the grease drain path;

a chamber positioned downstream of the grease drain opening, wherein the chamber leads to both the water drain path and the water recirculation path; and a baffle wall positioned between the grease drain opening and the chamber, wherein the baffle wall controls flow of liquids to the chamber.

2. The oven of claim 1, wherein the wash pump is at a first end of the chamber and the drain pump or drain valve is at a second end of the chamber, the second end opposite the first end.

3. The oven of claim 1, further comprising a door movable between an open position and a closed position for accessing the cooking chamber, the door including a latch member that automatically latches upon closure of the door.

4. The oven of claim 3, wherein the latch member is biased into a latching position and includes a ramped surface that interacts with a latch pin upon door closure to temporarily move the latch member out of its latching position.

5. The oven of claim 1, further comprising:

a door movable between an open position and a closed position relative to an access opening of the cooking chamber; and a gasket positioned between the door and an oven housing when the door is in the closed position to redirect sprayed water that impinges upon the door back into the cooking chamber.

6. The oven of claim 5, wherein the door includes a latch member that automatically latches upon closure of the door.

7. The oven of claim 6, wherein the door includes an inner glass pane and an outer glass pane, wherein the inner glass pane is rigidly mounted to a frame of the door for movement therewith, and the outer glass pane is movably mounted to the frame.

8. An oven, comprising:

a cooking chamber;

a spray system for spraying cleaning fluid in the cooking chamber; and a chamber drain flow path that leads to each of a grease drain path, a water drain path and a water recirculation path, wherein the water drain path includes an associated drain pump or drain valve, the water recirculation path includes an associated wash pump to deliver liquid to the spray system, and the grease drain path leads to a grease collecting compartment or container, wherein flow along the grease drain path is by gravity under selective control by a controllable valve;

a grease drain opening positioned in the chamber drain flow path and leading to the grease drain path;

a chamber positioned downstream of the grease drain opening, wherein the chamber leads to both the water drain path and the water recirculation path;

a baffle wall positioned between the grease drain opening and the chamber, wherein the baffle wall controls flow of liquids to the chamber, wherein the wash pump is at a first end of the chamber and the drain pump or drain valve is at a second end of the chamber, the second end opposite the first end; and a controller configured to maintain the controllable valve in an open condition during cooking operations such that grease flows downward through the grease drain opening and along the grease drain path under the force of gravity without overflowing the baffle wall.

* * * * *